US006361396B1

(12) United States Patent
Snyder et al.

(10) Patent No.: US 6,361,396 B1
(45) Date of Patent: Mar. 26, 2002

(54) RF IDENTIFICATION SYSTEM FOR USE IN TOYS

(75) Inventors: Don Snyder, Napa; Kent Suzuki, Oakland, both of CA (US)

(73) Assignee: Bill Goodman Consulting, LLC, Portland, ME (US)

( * ) Notice: Subject to any disclaimer, the term of this patent is extended or adjusted under 35 U.S.C. 154(b) by 0 days.

(21) Appl. No.: 09/504,520

(22) Filed: Feb. 15, 2000

Related U.S. Application Data

(60) Provisional application No. 60/148,906, filed on Aug. 13, 1999.

(51) Int. Cl.[7] ..... A63H 3/28; A63H 13/00

(52) U.S. Cl. ..... 446/397; 446/297; 446/298; 446/353; 446/484

(58) Field of Search ..... 434/169, 201; 446/175, 297, 298, 303, 352, 353, 397, 484

(56) References Cited

U.S. PATENT DOCUMENTS

| | | | | |
|---|---|---|---|---|
| 4,207,502 A | | 6/1980 | Omura | |
| 4,221,927 A | | 9/1980 | Dankman et al. | |
| 4,231,184 A | | 11/1980 | Corris et al. | |
| 4,245,430 A | | 1/1981 | Hoyt | |
| 4,507,653 A | | 3/1985 | Bayer | |
| 4,516,950 A | | 5/1985 | Berman et al. | 446/297 |
| 4,675,519 A | | 6/1987 | Price | |
| 4,696,653 A | | 9/1987 | McKeefery | 446/175 |
| 4,809,335 A | | 2/1989 | Rumsey | |
| 4,840,602 A | | 6/1989 | Rose | 446/175 |
| 4,857,030 A | | 8/1989 | Rose | 446/303 |
| 5,092,811 A | | 3/1992 | Bergenguer | 446/301 |
| 5,108,341 A | | 4/1992 | DeSmet | 446/299 |
| 5,281,143 A | | 1/1994 | Arad et al. | 434/185 |
| 5,290,198 A | | 3/1994 | Nakayama | 446/297 |
| 5,314,336 A | | 5/1994 | Diamond et al. | |
| 5,415,579 A | | 5/1995 | Pracas | 446/295 |
| 5,443,388 A | | 8/1995 | Jurmain et al. | 434/238 |
| 5,495,557 A | | 2/1996 | Hyman et al. | |
| 5,603,652 A | | 2/1997 | Rothschild et al. | 446/130 |
| 5,655,945 A | | 8/1997 | Jani | 446/299 |
| 5,795,213 A | * | 8/1998 | Goodwin | 446/297 |
| 5,815,091 A | | 9/1998 | Dames et al. | 340/870.34 |
| 5,820,441 A | | 10/1998 | Pracas | 446/354 |
| 5,847,854 A | | 12/1998 | Benson, Jr. | 359/147 |
| 5,864,626 A | | 1/1999 | Braun et al. | 381/81 |
| 6,089,943 A | | 7/2000 | Lo | 446/175 |
| 6,110,000 A | | 8/2000 | Ting | 446/302 |
| 6,135,845 A | * | 10/2000 | Klimpert et al. | 446/297 |
| 6,159,017 A | * | 12/2000 | Coomansingh | 446/297 X |
| 6,171,168 B1 | | 1/2001 | Jessop | 446/297 |

* cited by examiner

*Primary Examiner*—John A. Ricci
(74) *Attorney, Agent, or Firm*—McCutchen, Doyle, Brown & Enersen LLP; David G. Beck

(57) ABSTRACT

A method and apparatus which allows one toy to identify a plurality of objects is provided. The system relies on the inductive coupling of the toy with a tank circuit contained within the object to be identified and therefore does not require physical contact between the toy and the object. The sensing circuit includes a variable frequency RF oscillator and an air wound coil to radiate a magnetic flux which couples to the air surrounding the coil. The resonant frequency of a tank circuit inductively coupled to the sensing circuit serves as the signature for the object. In one approach, the frequency of the RF oscillator is varied over a range of frequencies while the current drawn by the oscillator is monitored. The current draw provides a means of identifying an object since the current will be at a minimum when the oscillator frequency substantially corresponds to the resonant frequency of the inductively coupled tank circuit. In another approach, the object identifying function of the toy is broken up into an oscillation generating step and an oscillation sensing step. During the sensing step, the toy monitors for ringing emitted by the tank circuit of an object, the ringing due to the oscillation of the tank circuit after the oscillation stimulus has been removed.

27 Claims, 9 Drawing Sheets

RF IDENTIFICATION SYSTEM FOR USE IN TOYS

CROSS-REFERENCES TO RELATED APPLICATIONS

This application claims priority of provisional patent application Ser. No. 60/148,906 filed Aug. 13, 1999, the disclosure of which is incorporated herein by reference for all purposes.

FIELD OF THE INVENTION

The present invention relates generally to toys and, more particularly, to a toy that is capable of recognizing and identifying various objects placed in proximity to the toy.

BACKGROUND OF THE INVENTION

Over the last several decades, toys have become increasingly sophisticated, allowing a child to interact with the toy to an ever-increasing extent. Initially the interaction between a child and the toy was quite limited. For example, during the 1960's, several toys were introduced which included a voice playback mechanism activated by pulling a string on the back of the toy. Thus, for example, a child was able to elicit a variety of pre-recorded phrases such as "Hello, my name is Suzie" or "I am hungry" simply by pulling the string. Unfortunately as the pre-recorded phrases spoken by the doll were randomly ordered, the child quickly became bored with the toy.

In order to provide more positive interaction, newer toys are designed to perform a specific function in response to the child's actions. For example, U.S. Pat. No. 4,231,184 discloses a doll assembly which raises its arms and simulates a crying sound in response to a specific frequency sound signal emitted by squeezing a specific toy baby bottle. These actions can be stopped by inserting the nipple of the bottle into the doll's mouth, the insertion causing a switch to be opened. U.S. Pat. No. 5,290,198 discloses a more sophisticated doll assembly, one which is capable of responding both to an action on the part of the child, as well as a length of time that the action is performed. For example, by inserting the nipple of a bottle into the mouth of the doll, the doll emits a sound that simulates a baby drinking milk from a bottle. If the bottle is removed too quickly, the doll emits a sound that simulates a baby crying. In contrast, if the bottle is left in the doll's mouth for a sufficient period of time, the doll emits a sound simulating satisfaction. Additionally, the child can elicit responses by squeezing the doll. Besides mechanical sensors, this patent also discloses the use of light and magnetic sensitive switches.

In order to provide more stimulation as well as a better learning experience to a child, some toys are designed to provide the child with a varied and relatively complex response in reaction to one or more actions performed by the child. For example, U.S. Pat. No. 5,495,557 discloses an electronic book which includes a permanent memory containing an audio data base of a plurality of words and phrases, preferably arranged within categories such as subjects, verbs, adjectives, etc. As the child activates a series of switches, for example contained on a 'page' of the book, words and phrases are stored in a temporary memory. When the selections have been completed, for example by selecting a word or phrase within each grammar category, a complete sentence is formed. Using a voice synthesizer, the toy can then enunciate the sentence formed by the child.

Another type of interactive toy is capable of recognizing an object and providing a specific response as a result of the identity of the object. U.S. Pat. No. 5,314,336 discloses a technique for object recognition based on optical scanning. Specifically, the disclosed system houses an optical scanner in the toy which is capable of recognizing markings, such as bar codes, which are located on the object to be recognized. Unfortunately, toys utilizing optical scanners are typically expensive and relatively sensitive to breakage due to the use of optical components. Additionally, a child may find such a toy difficult and frustrating to use due to the conditions placed on scanning, i.e., a specific scanning path, direction, and speed. Lastly, the use of an optical scanner places design constraints on the object, specifically the object must include a suitable region to which the optical code can be affixed and this region must be kept relatively clean in order to insure proper scanning.

Other object recognition systems require physical contact between the master toy and the object, physical contact either allowing selective closure of encoding switches or completion of an electrical object identification circuit. Since this approach requires that the toy and the object be in physical contact, proximity identification is not allowed. This type of system also places various design constraints on both the toy and the object due to the required mating surfaces. Additionally, the master toy/object interconnections (e.g., switch pins, conductive connectors, etc.) are prone to failure due to damage resulting from contamination, scratching, or breakage.

Accordingly, what is needed is an object recognition system that is relatively inexpensive, places minimal design constraints on both the master toy and the object to be recognized, and does not require the toy and the object to be in physical contact. The present invention provides such a system.

SUMMARY OF THE INVENTION

The present invention provides a method and apparatus for allowing one toy, i.e., a master toy, to identify a plurality of other toys, i.e., objects, that are brought into proximity to the master toy. The sensing circuitry of the present invention does not require that the master toy and the object be placed in physical contact with one another, thus eliminating the need for electrical contacts, locating pins and surfaces, and/or switching pins. As a result, less design constraints are placed on the toy designer regarding size, shape, and texture. Additionally, toys utilizing this invention are generally less prone to failure than toys that use external electrical contacts that can corrode, or toys that use pins and the like which can be damaged by a small child, thus making the toy inoperative for its intended function.

The present invention relies on inductively coupling a remote circuit within the object to be identified with a sensing circuit within the master toy. The sensing circuit within the toy is a variable frequency RF oscillator, preferably controlled by an internal microprocessor. The RF oscillator uses an air wound coil to radiate a magnetic flux which couples to the air surrounding the coil. The object to be identified includes one or more tuned tank circuits, each of which may be comprised of an inductor and a capacitor or an inductor and either a crystal or a resonator, the resonant frequency or frequencies of the one or more tank circuits serving as a signature for the object. The approach of using an inductor coupled to either a crystal or a resonator is preferred as it offers both improved object discrimination and sensing range.

In at least one embodiment of the invention, the frequency of the RF oscillator is varied over a range of frequencies, preferably utilizing a series of preset output frequencies. While the frequency of the oscillator is varied, the current drawn by the oscillator is monitored. When an object containing a tank circuit becomes inductively coupled to the oscillator, the output coil of the oscillator circuit becomes loaded which affects the current drawn by the oscillator. If the oscillator frequency substantially corresponds to the resonant frequency of a tank circuit, the current drawn by the oscillator will be at a minimum.

In at least one other embodiment of the invention, the object identifying function of the master toy is broken up into an oscillation generating step and an oscillation sensing step. During the sensing step, the master toy monitors for ringing emitted by a tank circuit of an object, the ringing due to the oscillation of the tank circuit after the oscillation stimulus has been removed. Since two separate steps are used during sensing, the receiver circuit can include signal amplification circuitry which results in a greater object sensing range.

A further understanding of the nature and advantages of the present invention may be realized by reference to the remaining portions of the specification and the drawings.

DESCRIPTION OF THE SPECIFIC EMBODIMENTS

The present invention utilizes the technique of inductive coupling to allow a master toy to identify an object placed in proximity to its sensing circuit without requiring the toy and the object to be in physical contact. Since physical contact is not required, the object need not include electrical contact points, locating pins, switch activation pins, etc., thus minimizing the chances of system failure due to electrical contact corrosion or physical pin (e.g., locating pin or activation pin) corruption. Additionally, due to the internal nature of the circuitry, the object can have practically any desired shape and texture as long as the object is made of a RF transparent material such as plastic.

Figure 1:
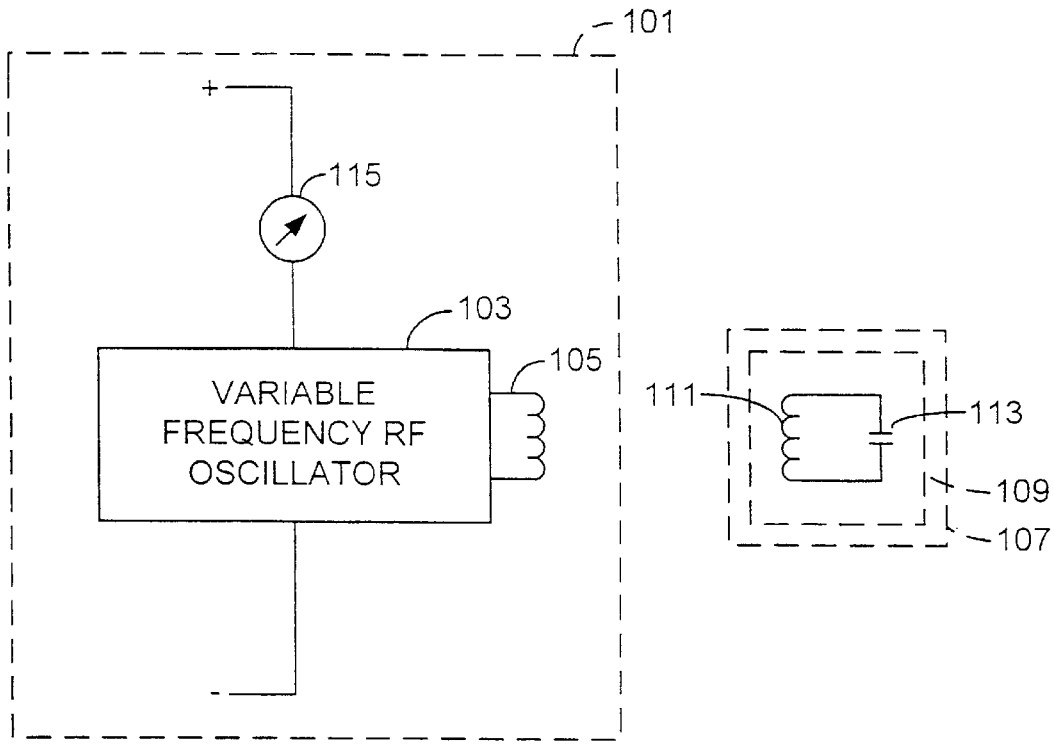
FIG. 1 schematically illustrates the basis of at least one embodiment of the invention.

FIG. 1 schematically illustrates the basis of at least one embodiment of the invention. As shown, a master toy 101 contains a variable frequency RF oscillator 103 which includes an air wound coil 105 as part of the oscillator's tuned circuit. An object 107 which is to be identified includes a tank circuit 109, for example an inductor 111 and a capacitor 113 in parallel as shown. When object 107 is brought into close proximity with toy 101, tank circuit 109 becomes inductively coupled to oscillator 103. As a result of the loading of coil 105 by tank circuit 109, the current drawn by oscillator 103 depends upon whether the oscillator frequency is above, below, or at the resonant frequency of tank circuit 109. In particular, when oscillator 103 is substantially at the resonant frequency of tank circuit 109, the current drawn by oscillator 103 will be at a minimum. Therefore by sweeping the frequency of oscillator 103 while monitoring the current drawn by the circuit with a current monitor 115, it is possible to identify object 107 using the resonant frequency of the tank circuit as a signature.

Figure 2:
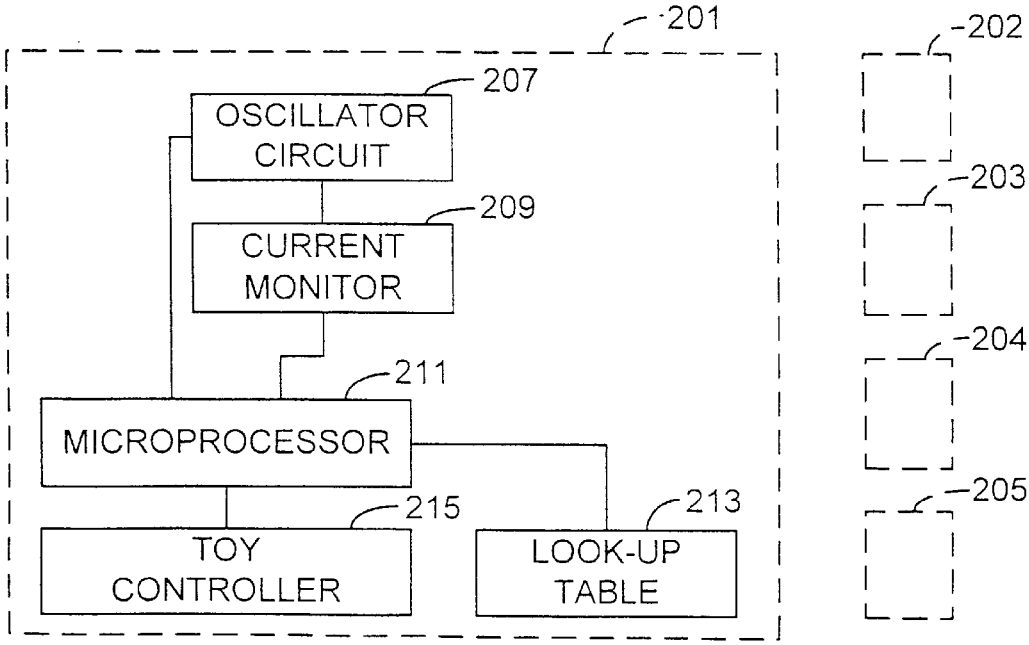
FIG. 2 is a block diagram illustrating an embodiment of the invention utilizing the RF inductive coupling system shown in FIG. 1.

FIG. 2 is a block diagram illustrating an embodiment of the invention utilizing the RF inductive coupling system shown in FIG. 1. A main toy 201 can be any of a variety of toys designed to identify various related objects 202–205, toy 201 preferably performing one or more actions in response to the identity of the object. In one example of an application of the invention, toy 201 is a doll and objects 202–205 are a piece of broccoli, a toothbrush, a tea cup, and an ice cream cone, respectively. As a child places one of the objects in proximity to the RF oscillator coil which is proximate to the doll's mouth, the doll identifies the object and responds accordingly. Suitable responses to objects 202–205 could be; "I love broccoli", "I brush my teeth after every meal", "Another cup of tea, please", and "I love ice cream", respectively.

It is understood that the present invention is neither limited to dolls nor is it limited to only four objects. For example, toy 201 can be shaped like a talking computer and designed to ask the child any of a variety of questions to which the child responds by placing an object (e.g., an object in the shape of an animal, word, letter, number, etc.) in proximity to the toy. Thus if toy 201 asks a math question such as "How much is 2+3?" and the child places an object in the shape of a "5" next to the computer, the computer would congratulate the child. If, on the other hand, the child responds to this question by placing an object in the shape of a "4" next to the computer, the computer could say "Close, try again". Or toy 201 can provide the child with hints such as "The answer is the same as the number of fingers you have on one hand". It is understood that toy 201 can be designed to perform functions other than speech in response to objects 202–205. For example, toy 201 could be capable of a variety of motions, could include a display screen, etc. It is understood that these are but a few of the possible applications of the present invention.

Regarding other aspects of the embodiment shown in FIG. 2, the circuitry within toy 201 includes a RF oscillator circuit 207 and a current monitor 209, both under the control of a microprocessor 211. Thus microprocessor 211 is used to sweep oscillator 207 as well as monitor the output from monitor 209. A look-up table 213, either external or internal to microprocessor 211, is used to compare the resonant frequencies of the identified objects with programmed signature data, thus allowing toy 201 to correctly identify individual objects from a plurality of objects. Microprocessor 211 also includes or is coupled to a toy controller 215. Toy controller 215 includes the necessary components to produce an action by toy 201 (e.g., servos for arm or other movement, speech synthesizer, etc.) in response to the identity of the object placed in proximity to oscillator circuit 207.

Figure 3:
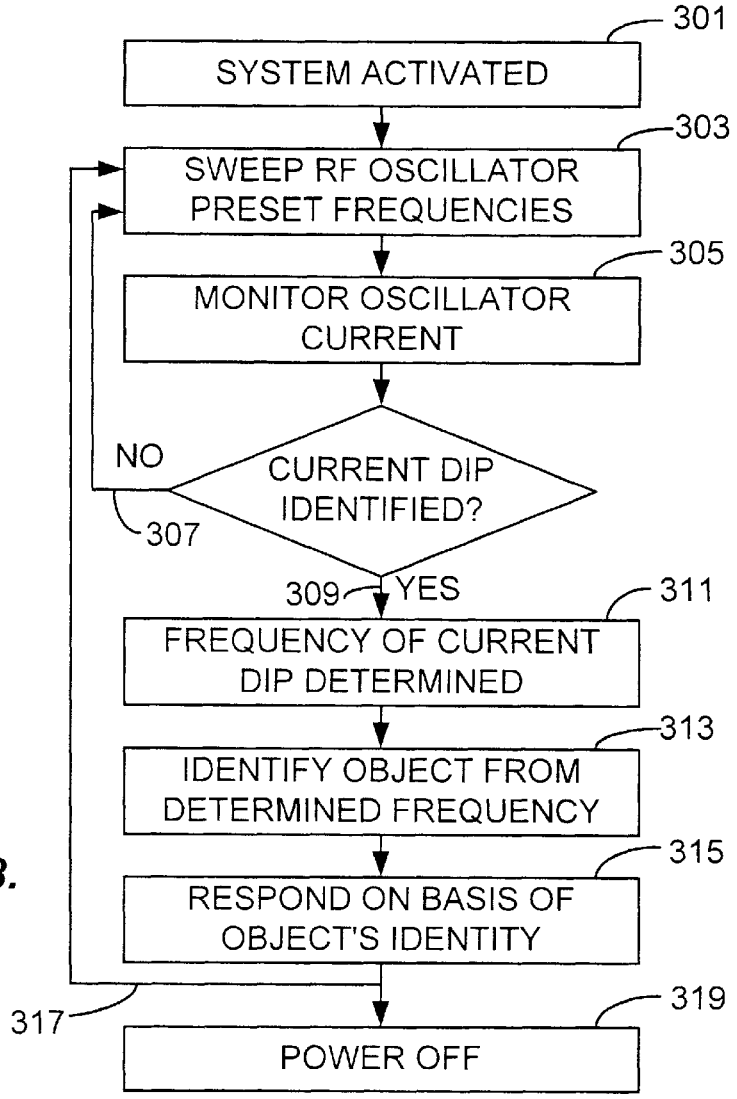
FIG. 3 illustrates a method that can be used with the invention.

FIG. 3 illustrates the method of at least one embodiment of the invention. Initially the master toy must be activated (step 301). This may be done by a manual on-off switch, a sensor switch (e.g., vibration sensitive switch, light sensitive switch, etc.), or other means. Once the toy is activated, the microprocessor sweeps the oscillator through a predetermined frequency range (step 303) while monitoring the current drawn by the oscillator circuit (step 305). If the current drawn by the monitor does not dip below a predetermined level (step 307), the system continues to sweep the frequency and monitor the current. If the current drawn by the monitor dips below the predetermined level (step 309), the frequency at which the oscillator experiences the current dip is determined (step 311) and the look-up table is used by the microprocessor to identify the object (step 313). Based upon the object's identity, the microprocessor causes the toy to perform the proper response (step 315). After the preprogrammed object response is completed, the microprocessor loops back (step 317) in order to continue sweeping the frequency and monitoring the current, the process continuing until the power to the toy is interrupted (step 319).

Figure 4:
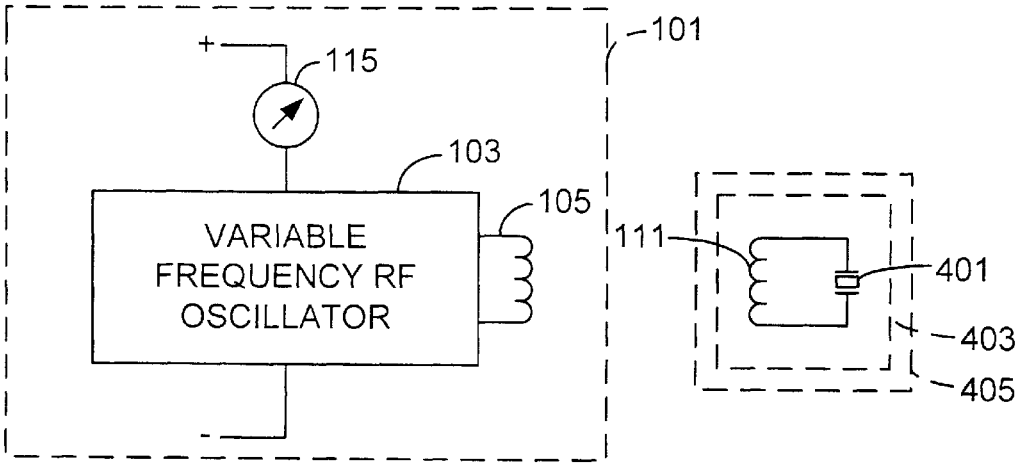
FIG. 4 is an illustration of an embodiment of the invention that provides an extended object sensing range.

FIG. 4 is an illustration of at least one other embodiment of the invention that provides a greater object sensing range. In this embodiment capacitor 109 of tank circuit 109 is replaced with a crystal or resonator. By coupling coil 111 with a crystal or resonator 401, a LC tank circuit is formed which exhibits a very sharp resonant frequency. A sharp resonant frequency is preferred as it allows the master toy to distinguish between a larger number of objects within the same frequency space than that achievable with a broader resonant frequency. Although crystal or resonator 401 is preferably in parallel with coil 111 as shown in LC tank circuit 403, LC tank circuit 403 being located within an object 405, it can also be in series with coil 111.

Regardless of whether the remote object utilizes the circuitry shown in FIG. 1 or FIG. 4, due to its simplicity it is very inexpensive to manufacture. As a consequence of the low cost, manufacturers can economically provide a large number of objects to be identified by the master toy, thus making a toy that is more enjoyable and, for certain toy designs (e.g., learning toys), more educational.

Figure 5:
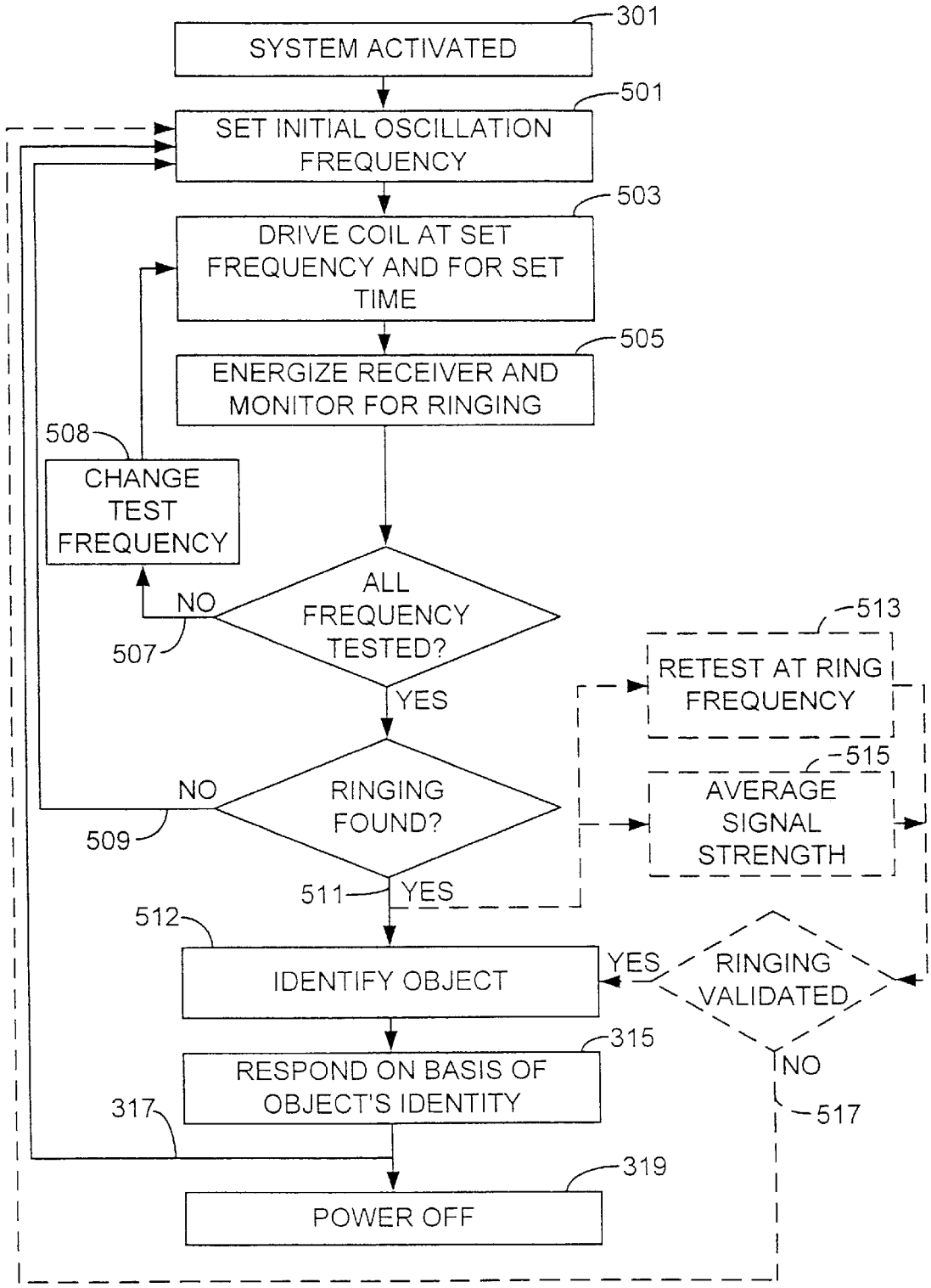
FIG. 5 illustrates a method that can be used with a dual step sensing embodiment of the invention.
Figure 6:
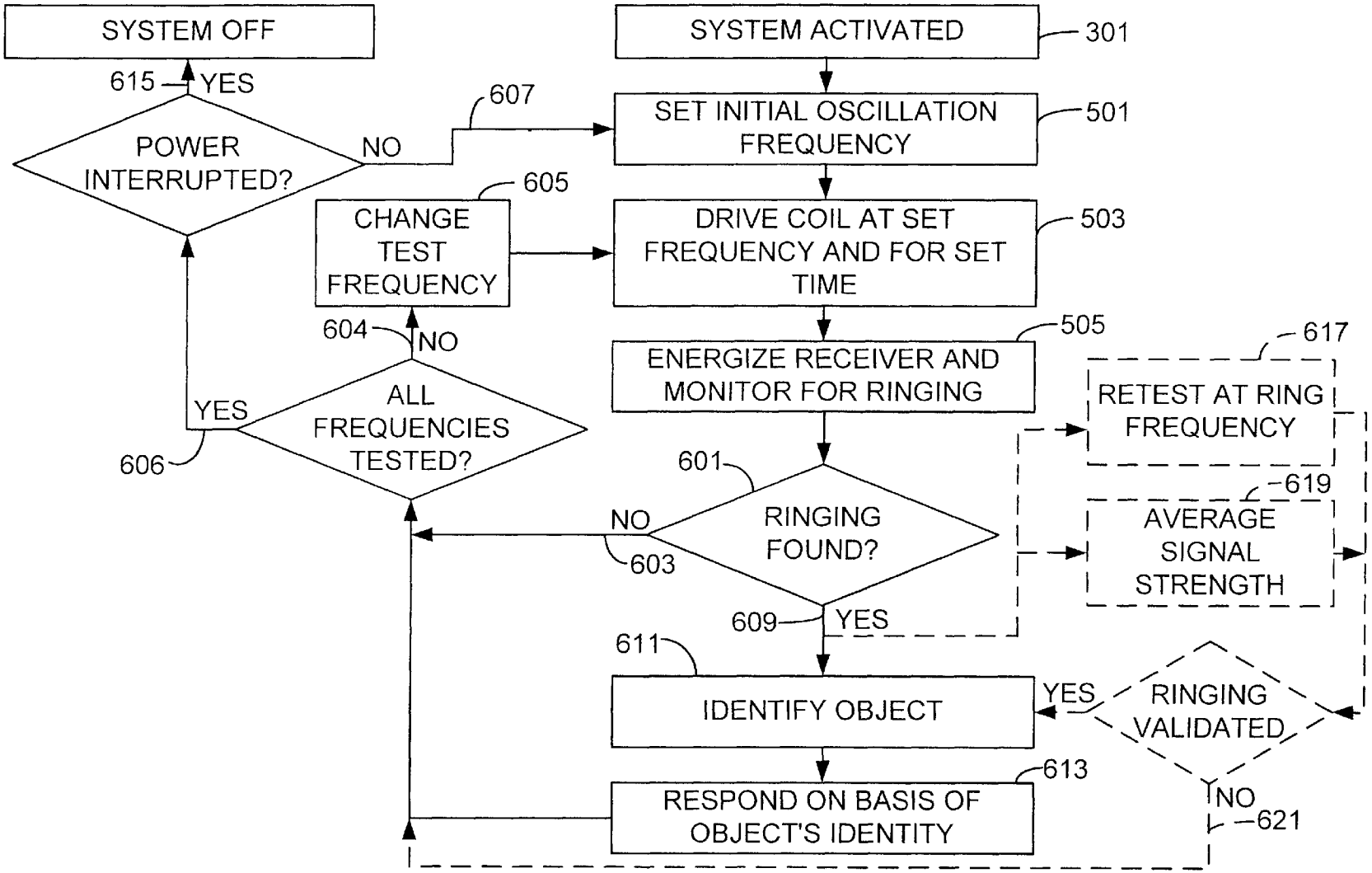
FIG. 6 illustrates an alternate method that can be used with a dual step sensing embodiment of the invention.

In the preferred embodiment of the invention, the RF oscillator does not continually sweep through a predetermined frequency range. Rather, and as illustrated in FIGS. 5 and 6, the sensing operation is split into two separate steps thereby utilizing the "ringing" of the tank circuit. The ringing phenomena is a result of the tank circuit, once stimulated, continuing to oscillate or ring for a period of time after the oscillation stimulus has been removed. During the ringing period, the tank circuit will radiate a RF signal. Ringing of the tank circuit continues until the energy within the tank circuit is dissipated through a combination of internal resistance and radiation loss. Since the sensing operation is broken into two separate steps, the receiver circuit can include signal amplification circuitry. Due to the gain resulting from the signal amplification circuitry, the master toy can detect an object that includes the appropriate tank circuit at a greater distance than is achievable using the system illustrated in FIG. 1.

As shown in FIG. 5, after the system is turned on (step 301), the oscillation frequency is set at an initial frequency (step 501). The air coil is then energized for a predetermined period of time (step 503). After completion of this step a receiver, preferably coupled to the same air coil, is energized for a predetermined period of time, the receiver monitoring for ringing of any remote tank circuits within its sensing range (step 505). In the embodiment of the invention illustrated in FIG. 5, the steps of energizing the master toy coil and then monitoring for ringing are repeated until all frequencies within the preset frequency range have been tested (steps 507–508). If during this looping operation the system does not detect ringing (step 509), the oscillator is reset to the initial frequency and the process starts over. If ringing is detected (step 511), the object is identified based on the test frequency for which ringing was observed (step 512) (for example, through the use of a look-up table), and the processor causes the toy to respond to the object as programmed (step 315). The system then restarts the process (step 317) until the power to the system is interrupted (step 319).

FIG. 6 illustrates a variation of the methodology shown in FIG. 5. In this embodiment the system determines for each test frequency whether or not ringing has been monitored (step 601) prior to altering the test frequency. If ringing is not found for a particular frequency (step 603) and all preset frequencies have not been tested (step 604), the system alters the test frequency (step 605) and re-performs the steps of energizing the oscillator coil and monitoring for ringing (steps 503 and 505). If ringing is not found for any of the preset frequencies (step 606) and the power to the system has not been interrupted (step 607), the system is reset to the initial oscillation frequency (step 501) and testing starts over. If ringing is found (step 609), the identity of the object is determined (step 611) based on the test frequency for which ringing was observed, for example using a look-up table, and a preprogrammed toy response is triggered (step 613). The process continues until power to the system is interrupted (step 615).

As previously noted, although the preferred embodiment utilizes the same air coil for both transmitting the test RF frequency and monitoring for tank circuit ringing, two separate coils can be used. The primary benefit associated with the use of a single coil is in saving manufacturing costs.

If desired, the methodology illustrated in FIGS. 5 and 6 can be modified to minimize the detection of false objects. For example, once a ringing signal has been found, the system can re-test at the same frequency (shown in phantom in step 513 of FIG. 5 and step 617 of FIG. 6). Alternately, the signal strength of the ringing can be averaged over a period of time (shown in phantom in step 515 of FIG. 5 and step 619 of FIG. 6). For either approach, if the system does not validate the ringing (shown in phantom in step 517 of FIG. 5 and step 621 of FIG. 6), it does not cause the toy to respond, rather it continues the process as if no ringing was initially found.

Figure 7:
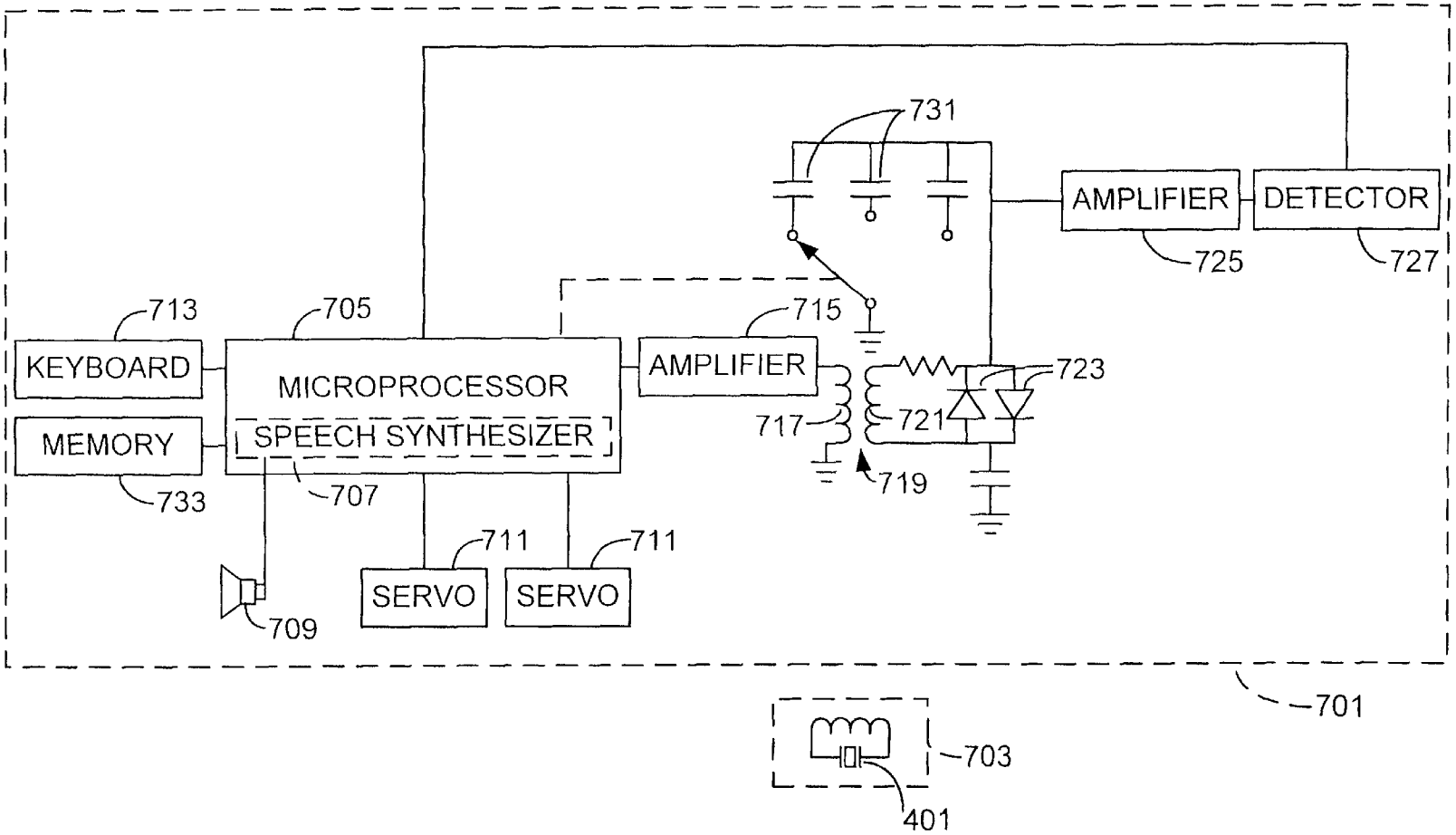
FIG. 7 is a simplified block diagram of an embodiment utilizing separate frequency generation and sensing steps.

FIG. 7 is a simplified block diagram of the preferred embodiment of the invention. As shown, a master toy 701 and an object 703 are designed to utilize the benefits of both the LC tank circuit and the split sensing circuitry. Within object 703 is an air coil 111 and a crystal or resonator 401. Although components 111 and 401 are shown in parallel, they can be serially coupled as previously discussed. Within toy 701 is a microprocessor 705 which is used to control the generation of the RF signal, the receipt of a signal from object 703, and control of the functionality of toy 701. Suitable microprocessors are manufactured by Sunplus of Taiwan as well as others. As shown, within microprocessor 705 is a speech synthesizer 707, synthesizer 707 coupled to a speaker 709. Alternately, speech synthesizer 707 can be separate from and coupled to microprocessor 705. Alternately, one or more servos 711 can be coupled to microprocessor 705, servos 711 operating various mechanical features associated with toy 701 (e.g., movement of arms, legs, hands, feet, mouth, eye lids, eyes, etc.). It is understood that servos 711 can be in lieu of, or in combination with, speech synthesizer 707.

Preferably coupled to microprocessor 705 is a keyboard 713. Keyboard 713 may be permanently mounted to toy 701, thus allowing the user to alter the programming or otherwise interface with microprocessor 705. Alternately, keyboard 713 can be mounted within toy 701 but not easily accessible by the user. In this instance keyboard 713 would be intended for use only by the manufacturer or for use during service of the toy. Alternately, keyboard 713 can be removably coupleable to toy 701, thus allowing system programming and testing during toy fabrication, while limiting the costs associated with the toy. Alternately, microprocessor 705 may be preprogrammed prior to the fabrication of toy 701, thus substantially eliminating the need for keyboard 713.

The frequency generation and tank circuit resonant frequency receiver aspects of the master toy circuit will now be discussed separately. It is understood that the sequence of testing can vary depending upon the desired application. Examples of appropriate methodology for use with this circuitry are shown in FIGS. 5 and 6.

During the first step of each two step sensing operation, microprocessor 705 generates the sensing frequency of interest, this frequency being amplified by driver or amplifier 715 prior to being coupled to a primary coil 717 of an air core transformer 719. Secondary coil 721 radiates magnetic flux which couples to the air surrounding the coil, the frequency of the flux being at the driving frequency as determined by microprocessor 705. If the frequency of the flux is different from the resonant frequency of the tank circuit within object 703, the tank circuit will simply absorb the energy but will not ring.

If the frequency of the flux generated by coil 721 is at the resonant frequency of the tank circuit within object 703, the tank circuit will ring as previously described. Secondary coil 721 of air core transformer 719 is used to pick up the ringing of the tank circuit. Alternately and as previously described, a separate receiver coil can be used. The common coil form shown in FIG. 7 is preferred, however, due to both the lower manufacturing costs and the reduced internal toy volume required to house the coils and associated circuitry.

A pair of diodes 723 is used to limit the received voltage, thus providing protection for the amplifier and gain circuitry of the receiver. It is understood by those of skill in the art that other techniques which rely upon zener diodes, varisters, incandescent bulbs, etc. can be used to limit the received signal level to an acceptable level. Typically diodes 723 are only required during the period of time when coil 721 is transmitting. In an alternate embodiment, instead of limiting the received signal level, the receiver section is simply disabled during the period of time when coil 721 is transmitting, preferably by using a switch under the control of microprocessor 705.

Coupled to the output of coil 721 are an amplifier 725 and a detector 727. The output of detector 727 is coupled to microprocessor 705, microprocessor 705 determining if a signal of sufficient intensity, i.e., one which exceeds a predetermined value, has been received by coil 721. The receipt of a signal of sufficient intensity indicates that a tank circuit which is tuned, i.e., resonates, at the frequency transmitted by coil 721 is within the coupling range of the system. Microprocessor 705 performs the preprogrammed response for the particular object identified by the system, preferably after validating the received signal.

In order to improve upon the rejection of non-resonant frequencies and maximize the amplitude of the resonant frequencies, preferably coil 721 of air core transformer 719 is tuned to the approximate frequency of interest. Although a variety of techniques are known that can perform this function, in the preferred embodiment, tuning is performed using a switch 729 and a plurality of capacitors 731 of varying capacitance. The switching system is under the control of microprocessor 705.

It is understood that although the detection system in FIG. 7 is preferred in order to achieve a low manufacturing cost, other detection systems can also be used. For example, other suitable detection systems include, but are not limited to, TRF, direct conversion, and superhetrodyne receivers.

As previously described with relation to the embodiment shown in FIG. 2 as well as the methodology figures, once a tank circuit resonates with the detection system, microprocessor 705 determines based on the resonance frequency an appropriate response, e.g., voice synthesized statement, action, etc. In order to determine the appropriate response, a look-up table is used in which resonant frequencies are cross-referenced with response instructions. The look-up table can either be contained within a separate memory 733 or included within microprocessor 705 as in the preferred embodiment.

Figure 8:
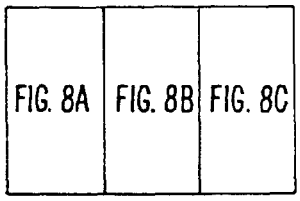
FIG. 8 is a detailed schematic of an embodiment of the invention utilizing the separate frequency generation and sensing steps shown in the simplified block diagram of FIG. 7.
Figure 8A:
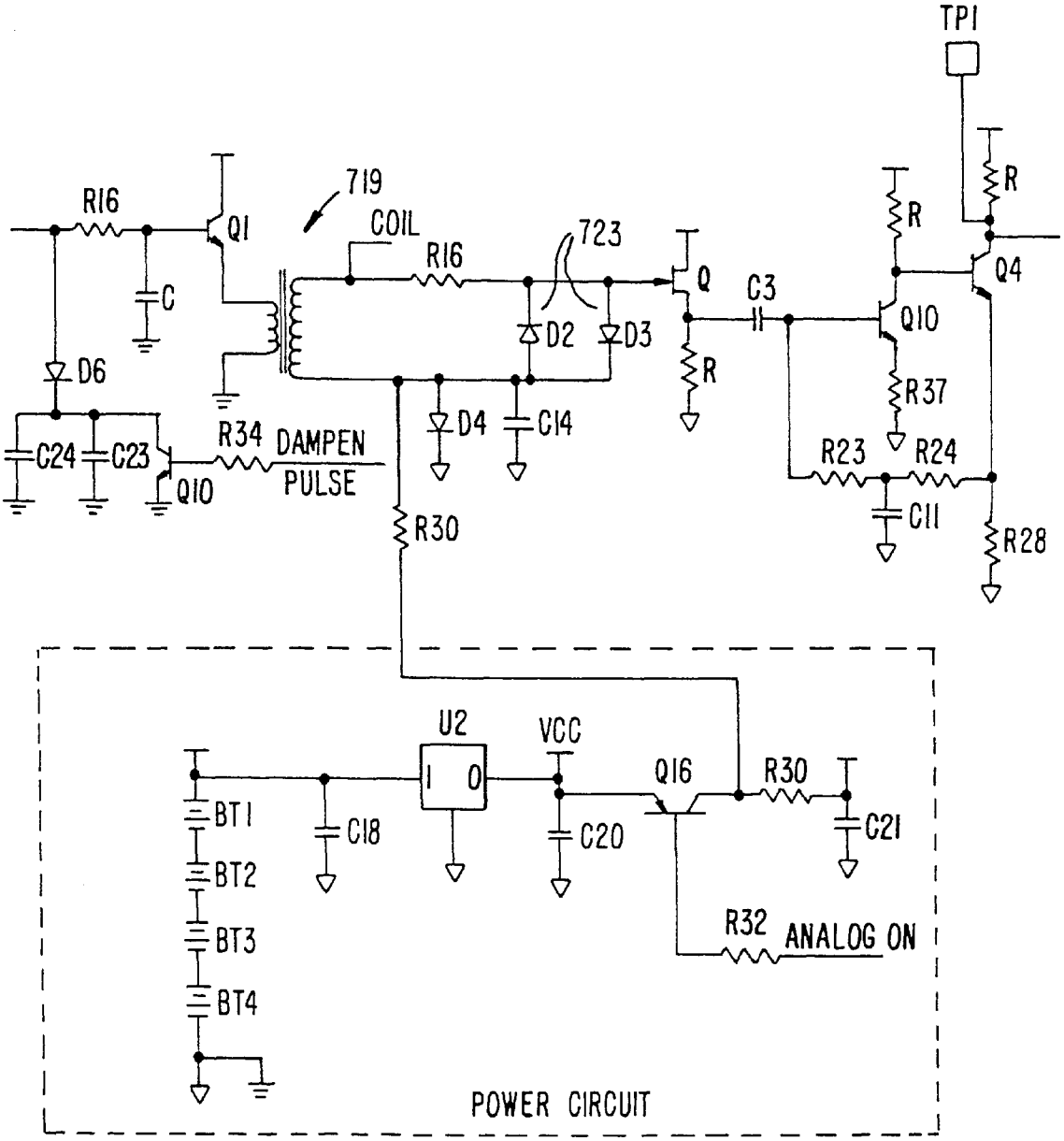
Figure 8B:
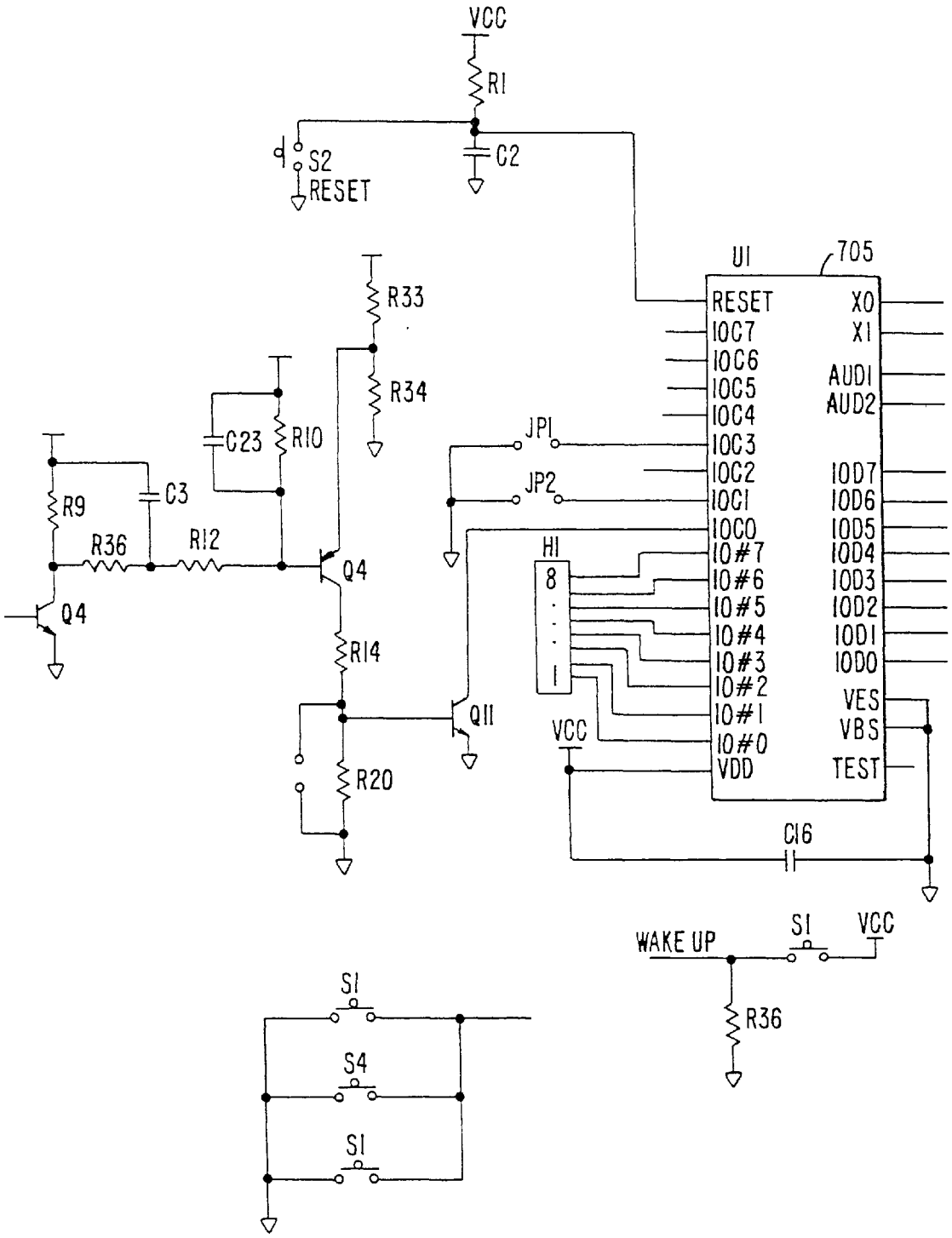
Figure 8C:
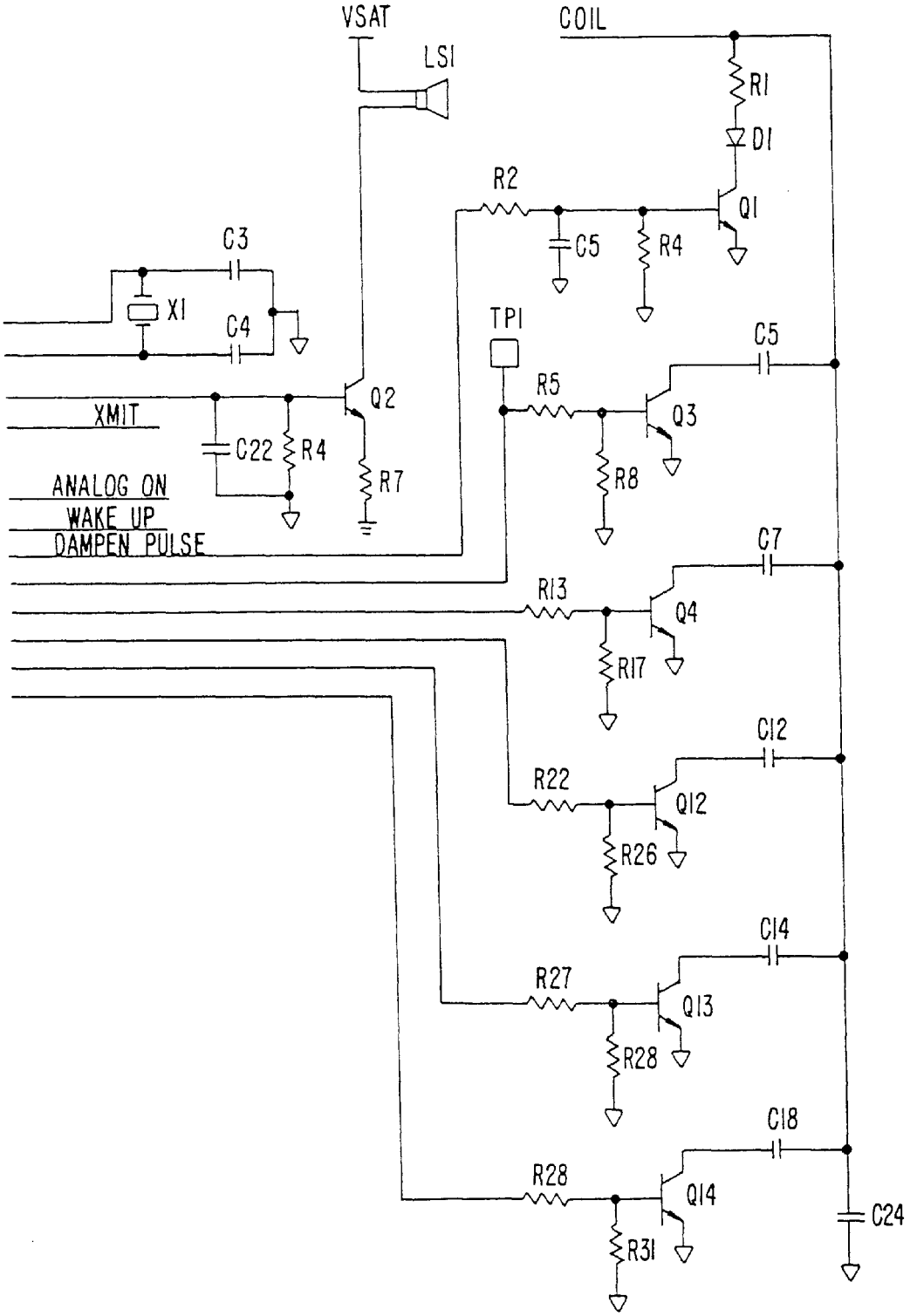

FIG. 8 is a detailed schematic of one embodiment of the invention utilizing the separate frequency generation and sensing steps as shown in the simplified block diagram of FIG. 7.

In another embodiment of the invention, microprocessor 705 is programmed to monitor the presence of object 703 and perform certain actions based on the object's continued proximity to toy 701. In other words, as opposed to simply performing an action when object 703 is first detected, processor 705 continues to perform the action as long as object 703 is in proximity to the toy. This capability can be used, for example, to have a toy doll continue to make a drinking sound as long as the system detects a baby bottle in proximity to the doll's mouth.

Besides simply detecting and acting upon the arrival and the continued presence of an object, processor 705 can be programmed to also perform an action after the detected object is removed from the sensing range. Thus in the above example the doll can initially be in a quiet state, begin making a drinking sound once the baby bottle is detected, continue to make the drinking sound as long as the baby bottle is detected, and then make a crying sound once the system detects that the baby bottle is no longer close to the doll's mouth.

The ability of the present invention to detect the arrival, continued presence, and departure of an object allows the microprocessor 705, in combination with either an internal or an external clock, to respond in various ways depending upon the length of time that an object is within sensing range. For example, a doll utilizing the present invention can be programmed to make a drinking sound when a baby bottle is placed near the doll's mouth, cry when the bottle is removed if the bottle has been kept near the doll's mouth for a time less than a predetermined time, and make a cooing sound when the bottle is removed if the bottle has been kept near the doll's mouth for a time greater than the predetermined time.

It is understood that in all embodiments of the present invention, due to the detection scheme being frequency dependent, multiple objects can be detected. In addition, this approach allows the number of objects that can be identified to be greater than the number of discretely detectable frequencies. For example, if the system is designed to be limited to four frequencies, F1–F4, a total of fourteen objects can be detected by utilizing combinations of the four discrete frequencies. In other words, not only will objects resonating at discrete frequencies F1, F2, F3, and F4 be identifiable, but also objects resonating with combinations of these four discrete frequencies, namely F1F2, F1F3, F1F4, F2F3, F2F4, F3F4, F1F2F3, F2F3F4, F1F2F4, and F1F3F4.

In at least one embodiment of the invention, the master toy is programmed to react to multiple objects which are simultaneously within the sensing space. Therefore in this embodiment frequency combinations within a single object, as previously described, are not allowed. Otherwise the master toy is not able to distinguish between a single object resonating at frequencies F1 and F2 and a pair of discrete objects, the first of which resonates at frequency F1 and the second of which resonates at frequency F2. Thus embodiment allows, for example, a toy truck to be programmed to emit an engine revving sound when a miniature driver is placed within the driver's seat and to move forward when a block shaped like a load of bricks is placed in the truck bed, these actions being performed simultaneously as long as both objects, i.e., the driver and the load of bricks, are within the sensing range of the toy truck's sensing coil and the frequency of each is of a different frequency so that they can be individually identified.

In another embodiment of the invention, microprocessor 705 is programmed to respond based not only on the identity of an object, but also on the proximity of the object to the master toy. Thus, for example, a doll which is programmed to cry once awakened (e.g., with the use of a vibration sensitive switch), can be programmed to cry at a gradually decreasing intensity and volume as the baby bottle is brought to the doll's mouth, and to change from a crying sound to a drinking sound once the bottle is close enough to the doll's mouth. As a consequence of this aspect of the invention, a toy can be designed which is more entertaining and which more thoroughly teaches a child the principle of cause and effect.

In order to provide object ranging, the amount of energy that is input into the remote tank circuit must be controlled. Such control can either be achieved by varying the length of time that the frequency is transmitted from coil 721 or, as in the preferred embodiment, by varying the amplitude of the generated frequency. Both of these transmission characteristics are under the control of microprocessor 705. Alternately, both the amplitude and the transmission time can be varied, thus providing further dynamic range.

The ability to control the input energy into the remote tank circuit allows the amount of energy radiated by the tank circuit to be controlled. Specifically, if a remote tank circuit receives less energy from the master toy, it will radiate less energy. As a consequence of radiating less energy, the remote object must be closer to the master toy to be detected. Therefore by varying the energy transmitted by the output coil, it is possible to detect whether a remote object is close to or far away from the master toy. Additionally, this system can be used to provide an approximation of the distance separating the toy and the remote object.

Figure 9:
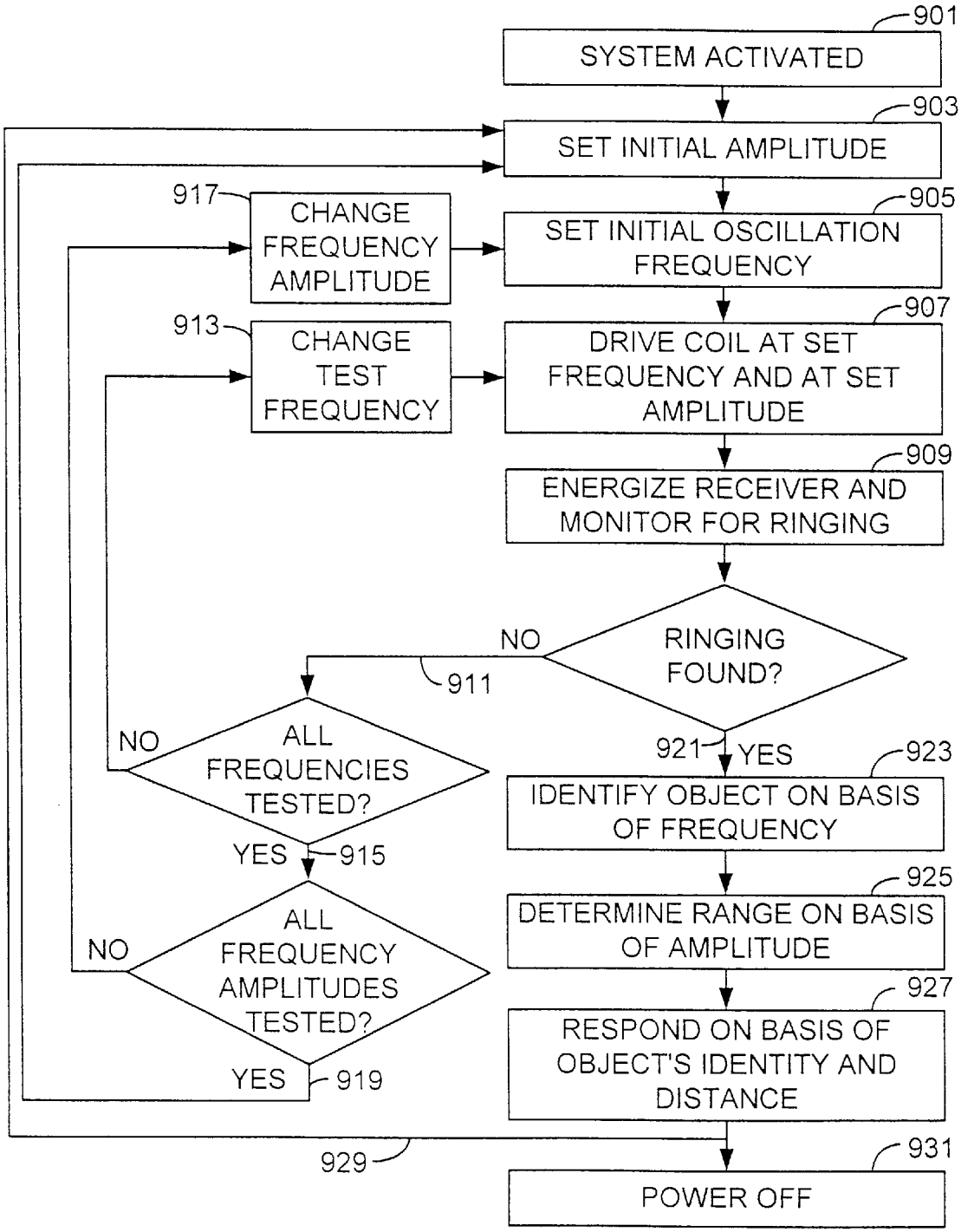
FIG. 9 illustrates a method that can be used with the present invention to determine the range of an identified object.

FIG. 9 is an illustration of the methodology that can be used with the system illustrated in FIGS. 7 and 8 to take advantage of the ranging aspects of the invention. It is understood that this is only meant to be illustrative, not limited, as other methodologies can utilize the same apparatus to achieve object ranging. For example, while the method illustrated in FIG. 9 is designed to vary the amplitude for each frequency, other methods could be implemented which vary the transmission period, either alone or in combination with a varying amplitude. Additionally, although the method shown in FIG. 9 tests all frequencies prior to varying the amplitude, in an alternate implementation the system can vary the amplitude and/or transmission period for a given frequency prior to altering the test frequency. It is understood that these are but a few of the methods that can be implemented to provide ranging using the present invention.

As shown in FIG. 9, after the system is turned on (step 901), an initial amplitude level is set (step 903) and the oscillation frequency is set to an initial test frequency (step 905). The air coil is then energized for the preset time period (step 907). After completion of this step a receiver, preferably coupled to the same air coil, is energized for a predetermined period of time, the receiver monitoring for ringing of any remote tank circuits within its sensing range (step 909). In this embodiment of the methodology if ringing is not found for a given test frequency (step 911), the process loops around, varying the test frequency between sensing cycles (step 913) until all preset test frequencies have been tested. If ringing is not detected after the system has looped through all test frequencies (step 915), the test frequency amplitude is changed (step 917), the oscillator is reset to the initial frequency (step 905), and the process starts over. If ringing is not detected after the system has looped through all test frequencies (step 915) and all amplitudes (step 919), the oscillator is reset to the initial amplitude and frequency (steps 903 and 905) and the process starts over.

After ringing is detected (step 921), the identity of the object is determined (step 923) based on the test frequency for which ringing was observed, for example using a look-up table. Similarly the range of the object is determined based on the test frequency amplitude (step 925). The toy then responds as programmed based on the identity of the object as well as its proximity (step 927). The system then restarts the process (step 929) until the power to the system is interrupted (step 931).

It is understood that regardless of the embodiment of the invention, the present system can operate in a pulsed, or non-continuous, mode. Thus after the system has been activated (step 301 of FIGS. 3, 5, and 6 and step 901 of FIG. 9), it can periodically test for the presence of an identifiable object rather than continuously testing for objects. For example, after step 317 of FIGS. 3 and 5, step 607 of FIG. 6, or step 929 of FIG. 9, an additional step can be inserted in which the system waits for a predetermined time period prior to repeating the testing operation. This mode of operation, which is especially useful in battery powered toys to further minimize power usage, is possible since the objects of the present invention operate in a passive mode and thus do not require timing coordination with the master toy.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. A toy comprising:

a variable frequency RF oscillator, said variable frequency RF oscillator generating a plurality of frequencies;

a RF receiver, said RF receiver outputting a signal in response to a received RF signal;

at least one remotely identifiable object, said at least one remotely identifiable object comprising at least one tank circuit, said at least one tank circuit comprising an inductor, said inductor capable of inductively coupling to said RF receiver, wherein each of said at least one tuned tank circuits has a resonant frequency; and a microprocessor coupled to said variable frequency RF oscillator and to said RF receiver, said microprocessor controlling selection of at least one ringing frequency from said plurality of frequencies and monitoring said RF receiver output signal, wherein said microprocessor identifies an individual object from said at least one remotely identifiable object based on said RF receiver output signal.

2. The toy of claim 1, further comprising:

a first air wound coil coupled to said RF oscillator; and a second air wound coil coupled to said RF receiver.

3. The toy of claim 1, further comprising an air wound coil coupled to said RF oscillator and to said RF receiver.

4. The toy of claim 1, further comprising an air core transformer, wherein a primary coil of said air core transformer is coupled to said RF oscillator, and wherein a secondary coil of said air core transformer is coupled to said RF receiver.

5. The toy of claim 1, wherein said RF oscillator does not generate said at least one ringing frequency from said plurality of frequencies simultaneously with said RF receiver receiving said RF signal.

6. The toy of claim 1, said variable RF oscillator further comprising an amplifier circuit for amplifying said generated plurality of frequencies.

7. The toy of claim 1, said RF receiver further comprising an amplifier circuit for amplifying said received RF signal.

8. The toy of claim 1, further comprising means for limiting said received RF signal.

9. The toy of claim 1, wherein said microprocessor controls a response of said toy to an individual object of said at least one remotely identifiable object.

10. The toy of claim 1, further comprising a speech synthesizer coupled to said microprocessor.

11. The toy of claim 1, wherein said at least one remotely identifiable object is comprised of a plurality of remotely identifiable objects, each of said plurality of remotely identifiable objects having a distinguishable frequency signature.

12. The toy of claim 1, said at least one tank circuit further comprising a capacitor.

13. The toy of claim 1, said at least one tank circuit further comprising a crystal.

14. The toy of claim 1, said at least one tank circuit further comprising a resonator.

15. A method of identifying an object, wherein said method is performed by a toy, the method comprising the steps of:

sequentially generating a plurality of frequencies with a RF oscillator contained within said toy;

energizing a RF receiver;

monitoring for a RF signal produced by said object with said energized RF receiver, said RF signal resulting from said object inductively coupling to said RF receiver at a resonant frequency of a tank circuit within said object;

determining a single frequency from said plurality of frequencies, said single frequency corresponding to said resonant frequency of said tank circuit within said object; and identifying said object on the basis of said determined single frequency.

16. The method of claim 15, wherein said frequency generating step and said RF receiver energizing step are performed sequentially.

17. The method of claim 15, wherein for each frequency of said plurality of frequencies, said frequency generating step is completed prior to said energizing and monitoring steps.

18. The method of claim 15, wherein said identifying step is further comprised of the step of comparing said determined single frequency to a look-up table containing the identity of each of a plurality of objects and each of a corresponding plurality of resonant frequencies.

19. The method of claim 15, further comprising the steps of determining a toy response on the basis of said identity of said object and performing said determined toy response.

20. The method of claim 15, further comprising the step of validating said RF signal, wherein said steps of determining and identifying are only performed if said RF signal is validated.

21. The method of claim 15, wherein each frequency of said plurality of frequencies is generated for a plurality of time periods.

22. The method of claim 21, further comprising the steps of:

determining a single time period from said plurality of time periods, said single time period corresponding to said monitored RF signal; and determining an approximate object distance on the basis of said single time period.

23. The method of claim 22, wherein said single time period corresponds to a minimum time period required for detecting said RF signal.

24. The method of claim 15, wherein each frequency of said plurality of frequencies is generated at a plurality of amplitudes.

25. The method of claim 24, further comprising the steps of:

determining a single amplitude from said plurality of amplitudes, said single amplitude corresponding to said monitored RF signal; and determining an approximate object distance on the basis of said single amplitude.

26. The method of claim 25, wherein said single amplitude corresponds to a minimum amplitude required for detecting said RF signal.

27. A method of identifying an object, wherein said method is performed by a toy, the method comprising the steps of:

sequentially generating a plurality of frequencies with a RF oscillator contained within said toy;

energizing a RF receiver;

monitoring for a RF signal produced by said object with said energized RF receiver, said RF signal resulting from said object inductively coupling to said RF receiver at least one resonant frequency of at least one tank circuit within said object;

determining at least one resonance matching frequency from said plurality of frequencies, said at least one resonance matching frequency corresponding to said at least one resonant frequency of said at least one tank circuit within said object; and identifying said object on the basis of said determined at least one resonance matching frequency.

* * * * *